United States Patent [19]

Dussourd et al.

[11] 4,364,185

[45] Dec. 21, 1982

[54] SYSTEM FOR DRYING WET, POROUS WEBS

[75] Inventors: Jules L. Dussourd, Princeton, N.J.; Oscar Luthi, Nashua, N.H.

[73] Assignee: Ingersoll-Rand Company, Woodcliff Lake, N.J.

[21] Appl. No.: 253,192

[22] Filed: Apr. 13, 1981

[51] Int. Cl.[3] ..... F26B 13/30

[52] U.S. Cl. ..... 34/122; 34/115; 68/5 D

[58] Field of Search ..... 34/114, 115, 122, 128, 34/129; 68/5 C, 5 D, 5 E, 8

[56] References Cited

U.S. PATENT DOCUMENTS 3,054,193 9/1962 Wright ..... 34/128

3,430,352 3/1969 Fleissner ..... 34/115

*Primary Examiner*—Larry I. Schwartz

*Attorney, Agent, or Firm*—F. S. Troidl

[57] ABSTRACT

The system comprises a stationary drum with at least one end having a large open area, and a coaxial, rotatable cylinder of larger diameter than the stationary drum mounted for rotation about the stationary drum.

The stationary drum has a plurality of circumferentially-separated, longitudinally-extending sets of gas baffles on its outside surface and a plurality of circumferentially-separated, longitudinally-extending sets of inwardly-extending louvers adapted to direct gas in an axial direction inside the stationary drum.

First sealing members and circumferentially-separated second sealing members each extend across the annular space between the stationary drum and the rotatable cylinder to divide the annular space into two different pressure zones.

6 Claims, 2 Drawing Figures

SYSTEM FOR DRYING WET, POROUS WEBS

Figure 1:
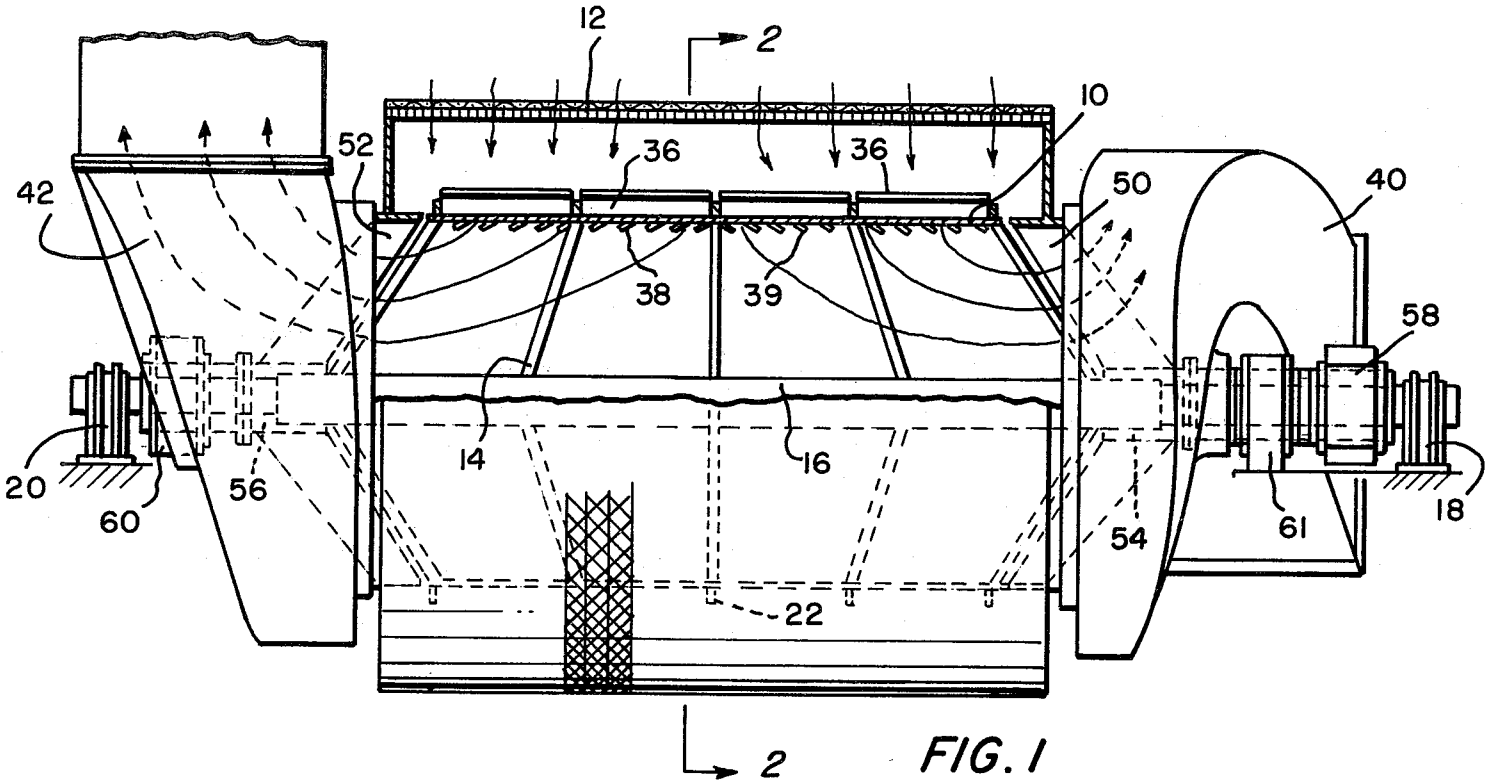

This invention relates to through-drying of wet, porous webs such as textiles, tissues, and toweling grades of paper. More particulary, this invention is a system for drying a wet porous web and including a means for assuring the uniform drying of the wet, porous web.

In through-drying, the wet web is fed to and then carried around an open-celled cylinder. Hot air, at between 400° F. to 900° F., is supplied through a hood which partially encases the outer circumference of the cylinder. The hot air is drawn through the web and through the cylinder shell to the interior of the cylinder by a vacuum source. The expended, moisture-laden air is then removed axially through one or both cylinder heads. A sealing arrangement inside the cylinder is provided to seal off the uncovered portion of the cylinder circumference.

Recently, an increasing number of large diameter cylinders, which may have a 16-foot diameter or larger, have been used to dry tissue on one cylinder at a high speed of up to 6000 feet per minute. Large quantities of air totaling as much as 35,000 CFM per foot of cylinder length must be pulled through the porous web to achieve the necessary drying.

The flow resistance through the web decreases with decreased moisture content. More flow in one section will decrease the moisture content in that section which, in turn, decreases the flow resistance and will cause even more drying in the same section at the expense of other sections. It is obviously, therefore, very important that the drying air flow uniformly through porous web along the total cylinder length. Also, the air flow resistance out of the drum cylinder must be kept to a minimum. Even a small pressure drop will means a large increase in fan horsepower because of the large quantities of air involved.

This invention is a system for drying wet, porous webs and includes a new gas distribution system inside the cylinder. The distribution system assures even flow distribution along the cylinder length by keeping the pressure on the inside of the cylinder as nearly constant as possible. The new system also utilizes tangential air velocity to accelerate the air in the axial direction to minimize fan horsepower. Also, large pressure losses are avoided inside the distribution system by minimizing vortexing.

Briefly described, the invention comprises a coaxially-mounted stationary drum and a rotatable cylinder larger than the drum. The stationary drum has a plurality of circumferentially-separated, longitudinally-extending sets of gas baffles on the outside surface. The stationary drum also has a plurality of circumferentially-separated sets of inwardly-extending louvers adapted to directly gas axially. First sealing members and circumferentially-separated second sealing members each extend across the annular space between the drum and cylinder to divide the annular space into pressure zones of different pressure.

Figure 2:
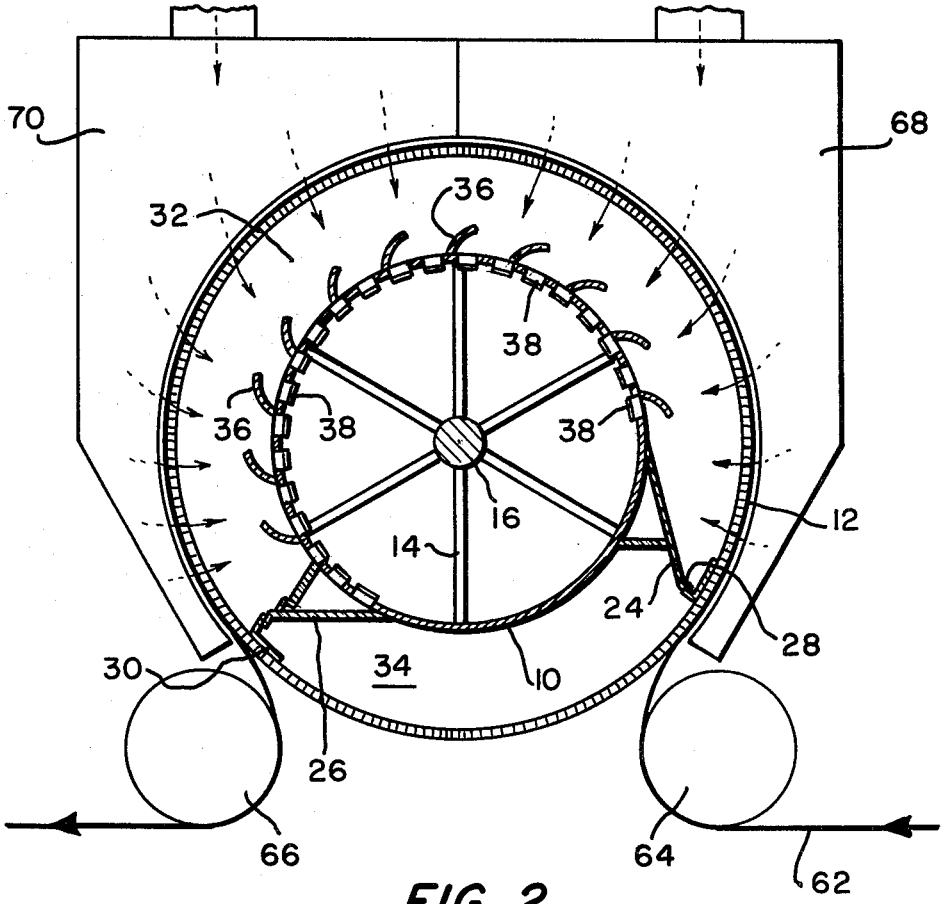

The invention, as well as its many advantages, may be further understood by reference to the following detailed description and drawings in which:

FIG. 1 is a side elevational view, partly in section, showing a preferred embodiment of the invention; and FIG. 2 is a view illustrating the new gas distribution system in a view taken along lines 2—2 of FIG. 1 in the direction of the arrows with this Figure also including a schematic representation of the gas hood and means for feeding the wet, porous web to the rotatable cylinder.

In the various figures, like numbers refer to like parts.

Referring to the drawings, and more particularly, to FIG. 1, the new system for drying a wet, porous web with hot gases includes a stationary drum 10. A coaxial, rotatable cylinder 12 of larger diameter than the stationary drum 10 is mounted for rotational movement about the stationary drum. The outer circumference of cylinder 12 is preferably provided with many large openings suitable for through-drying such as the cylinder described in U.S. Pat. No. 3,781,957, issued Jan. 1, 1974 to Oscar Luthi, entitled "Drum Including Annular Grid Structure".

The circumferential surface of the stationary drum 10 is supported by radial spokes 14 extending radially from a stationary center pipe 16. The stationary pipe 16 is supported at one end by the support 18 and supported at the other end by the support 20.

A reinforcing ring 22 is located about the outside of the outer surface of stationary drum 10 and longitudinally located at each set of radial spokes 14 to keep the drum 10 from going out of round due to the non-symmetrical vacuum loading.

Referring to FIG. 5, sealing members including zone baffles 24,26, which carry zone seals 28,30, respectively, each extend across the annular space between stationary drum 10 and rotatable cylinder 12 for the same length as the lengths of drum 10 and cylinder 12 to divide the annular space between the drum and cylinder into a vacuum zone 32 and an atmospheric zone 34.

A plurality of circumferentially-separated sets of longitudinally-extending gas baffles 36 are mounted on the outside surface of drum 10, and a plurality of circumferentially-separated sets of inwardly-extending louvers 38,39 are cut from the metal of the stationary drum 10, pushed inwardly, and slanted to direct gas which flows through the louvers in the axial direction inside the stationary drum 10 through gas exit scrolls 40,42. The stationary drum 10 is provided with a large open area head at each end to facilitate the flow of gas out of the ends of the drum.

The gas baffles 36 are curved and slanted in a direction opposite to the counterclockwise direction of rotation of cylinder 12 (see FIG. 2). As seen in FIG. 1, each louver 38 and each louver 39 is slanted toward the nearer drum head to such louver.

The louvers 38,39 and the baffles 36 are located in vacuum zone 32. The remainder of the drum 10 or that portion of the drum encompassed by the atmospheric zone 34 is solid.

The rotatable cylinder 12 is connected through radially-extending end spokes 50,52 to rotatable shafts 54,56 respectively. The shafts 54,56 are supported by pillow blocks 60,61 respectively. The entire cylinder 12 is driven through a shaft mounted gear box 58.

In operation, and looking at FIG. 2, the wet, porous web 62 to be dried is fed around a feed roll 64 and then to the rotatable cylinder 12 at a point on the rotatable cylinder in the vicinity of the first zone baffle 24. The wet web 62 is fed around the cylinder, leaves the cylinder in the vicinity of the second zone baffle 26, and is removed by take-off roll 66. As the web 62 moves around the drum, hot gas, which may amount to 500,000 CFM or more, is fed into hoods 68,70, through web 62, through cylinder 12, into the interior of stationary drum 10, and out of the system through the scrolls 40,42.

The hot gas will enter the vacuum zone 32 with a tangential velocity equal to the cylinder 12 rotational speed. This velocity has a tendency to increase in a contracting vortex as the air flows towards the center and will suffer a corresponding pressure loss. The gas baffles 36 serve to remove most of the tangential velocity in the gas and direct the gas flow into a radial direction.

The large number of louvered openings 38,39 direct and accelerate the gas flow in the axial directions. The louvered openings are dimensioned so that the velocity of gas through the louvers is uniform along the length of the rotatable cylinder 12 and is larger than the axial discharge velocity. The excess energy in the flow velocity is used to overcome the friction and shock losses caused by elements inside the stationary drum 10. In this manner, a uniform pressure profile over the total length of the rotatable cylinder 12 assures us of uniform drying. A small amount of gas rotation inside the stationary drum 10 is desirable because it minimizes the shock loss as the gas passes through the spokes 50,52 of the rotatable cylinder 12.

Looking at FIG. 2, it can be seen that hot gas which enters the vacuum zone 32 in the vicinity of the first zone baffle 24 will be tangentially directed toward the gas baffles 36 on the stationary drum 10. Also, it can be seen that the second zone baffle 26 is slanted at an acute angle with respect to the stationary drum 10 and in a direction such that gas in the vacuum zone 32, in the vicinity of the second zone baffle 26, is directed at an angle inwardly, toward, and through the louvers in the stationary drum 10. This structure eliminates abrupt changes in direction of the gas thereby preventing unwanted pressure losses.

We claim:

1. In a system for drying a wet, porous web with hot gases by flowing gas through the porous web: a stationary drum; a coaxial rotatable cylinder of larger diameter than the stationary drum mounted for rotational movement about the stationary drum, said rotatable cylinder having many large openings whereby a porous web on the external surface of the cylinder is dried by flowing gas through the web and the cylinder openings and into the cylinder; said stationary drum having a plurality of circumferentially-separated, longitudinally-extending gas baffles on its outside surface, said stationary drum also having a plurality of circumferentially-separated sets of inwardly-extending louvers attached to its inside surface, the gas baffles being positioned to direct gas in a radial direction inwardly through the louvers, the louvers being adapted to direct gas in an axial direction inside the drum; and first sealing members and circumferentially-separated second sealing members, each extending across the annular space between the stationary drum and the rotatable cylinder to divide said annular space into pressure zones of different pressure.

2. A system in accordance with claim 1 wherein: the air baffles are slanted in the direction opposite to the direction of rotation of the rotatable cylinder.

3. A system in accordance with claim 2 wherein: the louvers on each longitudinal half of the stationary drum are slanted in the direction of the nearer head of the stationary drum.

4. A system in accordance with claim 3 wherein: the first sealing members include a first zone baffle slanted in a direction such that gas in the annular space between the drum and cyinder which contacts said zone baffle will be tangentially directed toward the gas baffles on the stationary drum.

5. A system in accordance with claim 4 wherein: the second sealing members include a second zone baffle slanted at an acute angle with respect to the stationary drum and in a direction such that gas in the annular space between the drum and cylinder which contacts said second zone baffle will be directed toward the stationary drum.

6. A system in accordance with claim 5 wherein: the first sealing members and the second sealing members divide the annular space into a vacuum zone and an atmospheric pressure zone, the louvers and the gas baffles on the stationary drum are located in the vacuum zone, and the remainder of the drum is solid.

* * * * *